US006897814B2

(12) United States Patent
Iwai et al.

(10) Patent No.: US 6,897,814 B2
(45) Date of Patent: May 24, 2005

(54) MOBILE RADIO

(75) Inventors: Hiroshi Iwai, Neyagawa (JP); Atsushi Yamamoto, Osaka (JP); Koichi Ogawa, Hirakata (JP); Shinji Kamaeguchi, Kadoma (JP); Tsukasa Takahashi, Kawasaki (JP); Kenichi Yamada, Yokohama (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 618 days.

(21) Appl. No.: 09/988,715

(22) Filed: Nov. 20, 2001

(65) Prior Publication Data

US 2002/0061775 A1 May 23, 2002

(30) Foreign Application Priority Data

Nov. 22, 2000 (JP) ..... 2000-355437

(51) Int. Cl.[7] ..... H01Q 1/24

(52) U.S. Cl. ..... 343/702; 343/700 MS; 343/828; 343/841

(58) Field of Search ..... 343/700 MS, 702, 343/828, 841, 846, 848

(56) References Cited

U.S. PATENT DOCUMENTS

| | | | | |
|---|---|---|---|---|
| 4,827,266 A | * | 5/1989 | Sato et al. | 343/700 MS |
| 5,764,190 A | * | 6/1998 | Murch et al. | 343/702 |
| 6,014,113 A | * | 1/2000 | Orchard et al. | 343/841 |
| 6,130,650 A | * | 10/2000 | Curtis et al. | 343/846 |
| 6,417,817 B1 | * | 7/2002 | Pirila et al. | 343/841 |
| 6,614,400 B2 | * | 9/2003 | Egorov | 343/702 |
| 6,633,261 B2 | | 10/2003 | Iwai et al. | 343/700 MS |

FOREIGN PATENT DOCUMENTS

| | | |
|---|---|---|
| DE | 197 37 544 | 3/1999 |
| DE | 198 22 371 | 11/1999 |
| EP | 0 867 967 | 9/1998 |
| EP | 0 872 912 | 10/1998 |
| EP | 1 026 774 | 8/2000 |
| EP | 1 052 723 | 11/2000 |
| WO | 99 43043 | 8/1999 |

OTHER PUBLICATIONS

Poddar D. R. et al "On some board–band microstrip resonators" IEEE Transactions on Antennas and Propagation, IEEE Inc. New York, US, vol. AP–31, No. 1, Jan. 1986, pp. 193–194.

Patent Abstracts of Japan vol. 1998, No. 13, Nov. 30, 1998 & JP 10 224142 A (Kenwood Corp), Aug. 21, 1998.

Patent Abstracts of Japan vol. 2000, No. 11, Jan. 3, 2001 & JP 2000 216630 A (Alps Electric Co Ltd), Aug. 4, 2000.

* cited by examiner

*Primary Examiner*—Shih-Chao Chen
(74) *Attorney, Agent, or Firm*—Wenderoth, Lind & Ponack, L.L.P.

(57) ABSTRACT

A small-sized mobile radio has a built-in antenna is high enough to enhance the antenna characteristics. In the mobile radio, a base plate is structured by a section (antenna-housing section) including a supply portion and a short-circuiting portion, for example, of an antenna element which affect the antenna characteristics, and a section (circuit-housing section) which is the rest of the base plate. The antenna-housing section is so positioned so as to keep the built-in antenna high enough, that is, to keep the space between the base plate and the antenna element large enough. On the other hand, the circuit-housing section is positioned toward the back of the cabinet to provide room for a display and a key section.

22 Claims, 9 Drawing Sheets

FRONT VIEW FROM ANTENNA-HOUSING BASE PLATE 38

CROSS-SECTIONAL SIDE VIEW FROM ANTENNA-HOUSING BASE PLATE 38

CROSS-SECTIONAL SIDE VIEW OF TWO-CONNECTED BASE PLATES

FRONT VIEW FROM ANTENNA-HOUSING BASE PLATE 38

CROSS-SECTIONAL SIDE VIEW FROM ANTENNA-HOUSING BASE PLATE 38

FRONT VIEW FROM CIRCUIT BASE PLATE 39

FRONT VIEW OF ANTENNA-HOUSING BASE PLATE 38 AND CIRCUIT-HOUSING BASE PLATE 39 CONNECTED TO EACH OTHER

A DRAWING FOR SHOWING A SLOT

A DRAWING FOR SHOWING SHORT-CIRCUITING CONNECTION MEMBERS

MOBILE RADIO

BACKGROUND OF THE INVENTION

1. Field of the Invention

The present invention relates to mobile radios and, more particularly, to mobile radios in which antennas are equipped for receiving and transmitting radio waves exemplified as mobile phone terminals.

2. Description of the Background Art

The technology relating to mobile communications which is commonly applied to mobile phones, for example, has recently seen a rapid growth. In such mobile phones, antennas are considered especially important, and in keeping with the mobile terminals getting smaller, the antennas are required to be downsized to fit therein.

With reference to the accompanying drawing, described below is an exemplary mobile radio antenna conventionally equipped in mobile phone terminals.

FIG. 8 schematically shows front and cross-sectional side views of a mobile phone terminal, e.g., mobile radio, which has a conventional mobile radio antenna equipped therein.

In FIG. 8, the conventional mobile phone terminal includes a cabinet 101, a display 102 exemplified by a liquid crystal display, a key section 103 exemplified by a ten-key numeric pad, a battery 104, a built-in antenna 106, and a base plate 105 for electrical connections among those constituents. The built-in antenna 106 is structured by an antenna element 106*a* of a planar configuration, and two metal leads 106*b* and 106*c*. This type of built-in antenna 106 is generally called as a planar inverted F antenna (PIFA). The antenna element 106*a* is provided with a predetermined voltage from a supply point 107 on the base plate 105 via the metal lead 106*b*. The antenna element 106*a* is connected to a ground (GND) level of the base plate 105 via the metal lead 106*c*. Here, the length of a perpendicular line from the antenna element 106*a* to the base plate 105, i.e., space therebetween, is defined as an antenna height $h_0$.

This antenna height $h_0$ considerably affects the characteristics of the built-in antenna 106 including resonant frequency and frequency bandwidth, i.e., the larger the height $h_0$, the better the antenna characteristics. Other than the height $h_0$, the deciding factors for the antenna characteristics are the size of the antenna element 106*a*, the positional relationship between the metal leads 106*b* and 106*c*, and the like.

However, the conventional mobile radio antenna structured as above has a problem that the larger height $h_0$ results in the thicker mobile phone terminals, thus failing in downsizing.

In order to reduce the thickness of the mobile phone terminals, on the other hand, there is no other choice but to reduce the antenna height $h_0$. This is because the display 102, a speaker, and other constituents which are placed on the other side of the base plate 105 having the built-in antenna 106 disposed thereon cannot be reduced in thickness for this purpose. With the smaller antenna height $h_0$, however, the capacitive coupling between the antenna element 106*a* and the base plate 105 is increased. This will result in poor matching, and accordingly lower the antenna characteristics.

SUMMARY OF THE INVENTION

Therefore, an object of the present invention is to provide smaller-sized mobile radios in which their built-in antennas are high enough to enhance the antenna characteristics.

The present invention has the following features to attain the object above.

A first aspect of the present invention is directed to a mobile radio having an antenna equipped for receiving and transmitting radio waves. The mobile radio comprises: a base plate for providing a ground level; and a built-in antenna which is disposed on the base plate. The built-in antenna is provided with a supply portion at the upper end when the mobile radio is in a standing position, and is disposed so that a space to the base plate is decreased from the upper end to the lower end.

Preferably, the built-in antenna is an antenna of a planar configuration, and is so slanted that the space to the base plate is larger at the upper end than the lower end.

Alternatively, the built-in antenna is structured by a plurality of planes, and the plurality of planes are structured as steps so that the space to the base plate is larger at the upper end than at the lower end.

Alternatively, the built-in antenna is a planar inverted F antenna including an antenna element, a supply connection member to which a predetermined voltage is supplied, and a short-circuiting connection member which is grounded to the base plate, and the supply connection member and the short-circuiting connection member are disposed on the upper end.

As described above, in the present invention, the antenna characteristics can be enhanced by putting the supply portion higher. At the same time, the closeness between the lower part of the antenna and the base plate will increase the capacitive coupling therebetween, and resultantly lower the resonant frequency of the antenna. Further, from a design perspective, users' hands do not cover the antenna part when holding the mobile radio, and the mobile radio has a better appearance.

Preferably, a shield is provided between the built-in antenna and the base plate, and the built-in antenna is fixed by a support base which is disposed on the shield.

With such a structure, the capacitive coupling can be controlled by adjusting the height of the shield, or the space between the shield and the built-in antenna, and this leads to easier impedance matching. Moreover, by fixing the built-in antenna with the help of the support base, the antenna characteristics can be stabilized.

Preferably, a cabinet which determines the outer appearance of the mobile radio is formed in accordance with the shape of the built-in antenna.

By doing so, from a design perspective, the mobile radio looks better, and users fingers do not cover the antenna part when holding the mobile radio.

Alternatively, the cabinet is structured at least by a first section which houses the built-in antenna, and a second section which is the rest of the cabinet, and the built-in antenna is previously attached to the first section.

With the structure having the built-in antenna attached to the cabinet in advance with accuracy, the resonant frequency of the antenna can be stabilized. As a result, the antenna characteristics can be also stabilized, and thus the band characteristics can be reduced in margin.

Here, the base plate may be structured by an antenna-housing base plate on which the built-in antenna is disposed, and a circuit base plate which is the rest of the base plate, and in such a case, the antenna-housing base plate and the circuit base plate are not aligned on a same plane.

If this is the case, preferably, the antenna-housing base plate and the circuit base plate are electrically connected to each other via a side wall.

As such, by structuring the base plate by the antenna-housing base plate and the circuit base plate, and by placing the circuit base plate not to alignment with the antenna-housing base plate for the purpose of housing any other constituents, the built-in antenna can be made high enough without increasing the thickness of the mobile radio. Accordingly, the antenna characteristics are to be enhanced.

Preferably, a slit is provided in the vicinity of a junction between the antenna-housing base plate and the circuit base plate.

In this case, the length of the slit is set to a ¼ wavelength of any desired resonant frequency.

With such a structure, the impedance considering the circuit base plate becomes maximum. Accordingly, the built-in antenna can be designed irrelevant to the circuit base plate, and the built-in antenna thus becomes more versatile, suitable for mass production.

Preferably, a space between the built-in antenna and the base plate is partially or entirely filled with a dielectric material.

As such, filling partially or entirely a space between the built-in antenna and the base plate with the dielectric material will downsize the built-in antenna, and also stabilize it on the base plate.

Still further, in the mobile radio of the present invention, the built-in antenna can resonate with at least two frequencies.

That is, the built-in antenna is provided with a short-circuiting connection members which determine, respectively, a first resonant frequency band and a second resonant frequency band, and either of the resonant frequency bands can be selectively covered by controlling conduction for the short-circuiting portions.

As a result, an antenna structure which selectively supplies two resonant frequency bands with a single built-in antenna can be realized.

Alternatively, the built-in antenna may be provided with a short-circuiting connection member and a slot which determine, respectively, a first resonant frequency band and a second resonant frequency band, and by an action of an antenna element and the slot, the first and second resonant frequency bands can be covered at the same time.

In other words, the entire antenna element determines the first resonant frequency band, and the slot part determines the second resonant frequency band. Therefore, an antenna structure which simultaneously supplies two resonant frequency bands with a single antenna can be realized.

These and other objects, features, aspects and advantages of the present invention will become more apparent from the following detailed description of the present invention when taken in conjunction with the accompanying drawings.

DESCRIPTION OF THE PREFERRED EMBODIMENTS

Described below are embodiments of the present invention by referring to the accompanying drawings.

First Embodiment

Figure 1:
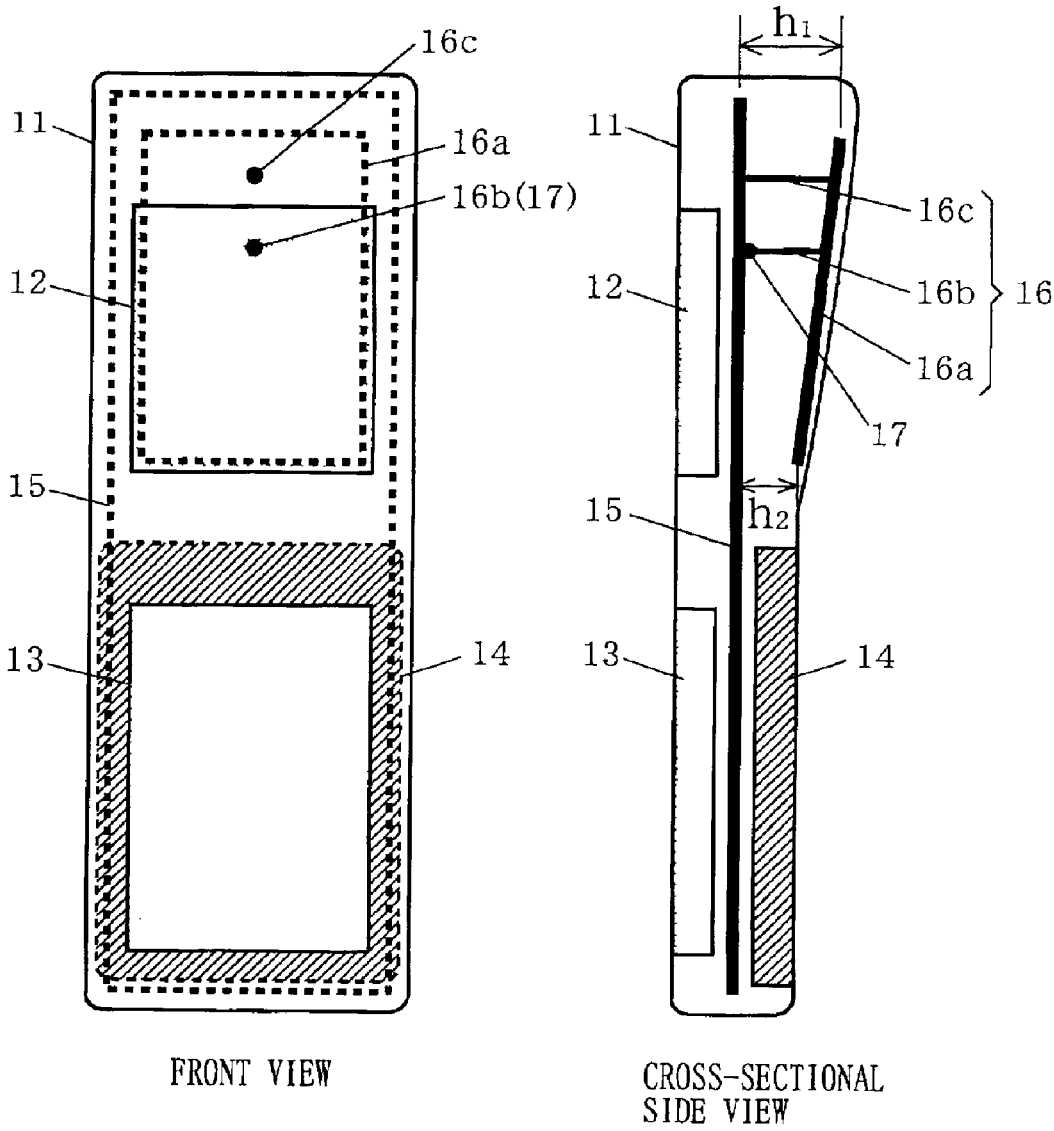
FIG. 1 is a schematic illustration showing the structure of a mobile radio according to a first embodiment of the present invention.

FIG. 1 schematically shows front and cross-sectional side views of a mobile radio according to a first embodiment of the present invention.

In FIG. 1, the mobile radio of the first embodiment includes a cabinet (case) 11, a display 12 exemplified by a liquid crystal display, a key section 13 exemplified by a ten-key numeric pad, a battery 14, a built-in antenna 16, and a base plate 15 for electrical connections among those constituents. The built-in antenna 16 is structured by an antenna element 16*a* of a planar configuration, and two metal leads 16*b* and 16*c*. The antenna element 16*a* is provided with a predetermined voltage from a supply point 17 on the base plate 15 via the metal lead 16*b*. The antenna element 16*a* is connected to a ground (GND) level of the base plate 15 via the metal lead 16*c*. Here, operating the GND pattern of a circuit board as the base plate is absolutely possible. Also, any cabinet or chassis made of conductive materials can be surely used as the base plate 15. Even if the cabinets or chassises are not conductive, covering those with the conductive material will be acceptable.

Here, perpendiculars exist from both upper and lower ends of the antenna element 16*a* to the base plate 15. The length of the perpendicular at the upper end is now referred to as an upper height $h_1$, while the length at the lower end as a lower height $h_2$. The antenna element 16*a* is so slanted against the base plate 15 as to satisfy $h_1>h_2$. Here, it is important that the metal leads 16*b* and 16*c* are so disposed as to be longer than the lower height $h_2$. Therefore the metal leads 16*b* and 16*c* are to be placed on the upper side of the built-in antenna 16, that is, the upper part of the cabinet 11.

With such placement, the metal lead 16*b* from its connecting portion (supply portion) on the antenna element 16*a* to the base plate 15, and the metal lead 16*c* from its connecting portion (short-circuiting portion) on the antenna element 16*a* to the base plate 15 become higher than the lower height $h_2$. This leads to easier impedance matching, and thus the, antenna characteristics will be enhanced. Moreover, by slanting the antenna element 16*a* against the base plate 15 as such, the lower height $h_2$ increases the capacitive coupling between the antenna element 16*a* and the base plate 15. This will reduce the resonant frequency of the antenna, whereby the antenna is to be successfully downsized.

In the case where the built-in antenna 16 is structured as above, the rear part of the cabinet 11 is formed so as to slant in accordance with the antenna element 16*a* as shown in FIG. 1. The rear part of the cabinet 11 thus looks smooth while ensuring that the lower height $h_2$ of the built-in antenna 16 is smaller. As a result, from a design perspective, the mobile radio has a better appearance, and users' hands do not cover the antenna part when holding the mobile radio.

Figure 2:
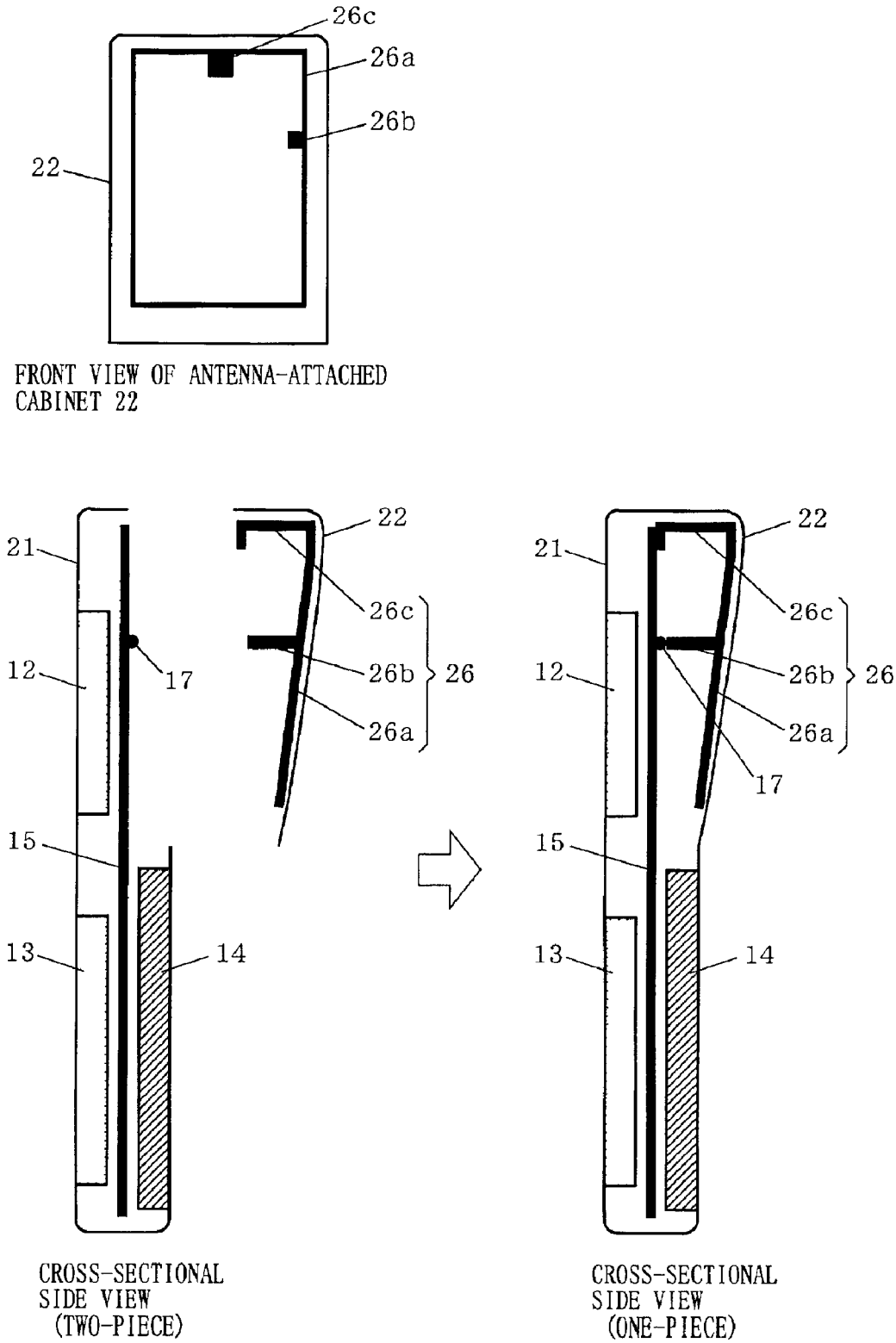
FIGS. 2 and 3 are schematic illustrations showing other structures of the mobile radio according to the first embodiment of the present invention.

Here, instead of fixing the built-in antenna 16 of FIG. 1 to the base plate 15 as above, the built-in antenna 16 may be previously attached to the inside of the slanting part of the cabinet 11. FIG. 2 shows an example of the mobile radio in such a structure. Here, in FIG. 2, any constituent identical to that in FIG. 1 is provided with the same reference numeral.

The mobile radio of FIG. 2 is structured by a cabinet (case) 21 and another cabinet (case) 22 with a built-in antenna 26 attached thereto (hereinafter, antenna-attached cabinet 22). The built-in antenna 26 is composed of an antenna element 26*a*, and two metal leads, i.e., a supply pin 26 and a shirt-circuit pin 26*c*. The antenna element 26*a* is fixed (attached) to the inside of the antenna-attached cabinet 22. To the antenna element 26*a*, the supply pin 26*b* and the short-circuiting pin 26*c* are electrically connected. Once such structured antenna-attached cabinet 22 is put together with the cabinet 21, the supply pin 26*b* is electrically connected to the supply point 17, and the short-circuiting pin 26*c* to the ground surface of the base plate 15.

With such a structure having the built-in antenna 26 attached to the antenna-attached case 22 in advance, space adjustment between the antenna element 26*a* and the antenna-attached case 22 can be made with accuracy.

The cabinet of the mobile radio is generally made of dielectric material, and thus the resonant frequency of the antenna varies depending on the positional relationship between the cabinet and the antenna, i.e., the closer, the lower the resonant frequency. Accordingly, with the structure having the built-in antenna 26 attached to the cabinet in advance, the resonant frequency of the antenna can be stabilized. As a result, the antenna characteristics can be also stabilized, and thus the band characteristics can be reduced in margin.

Figure 3:
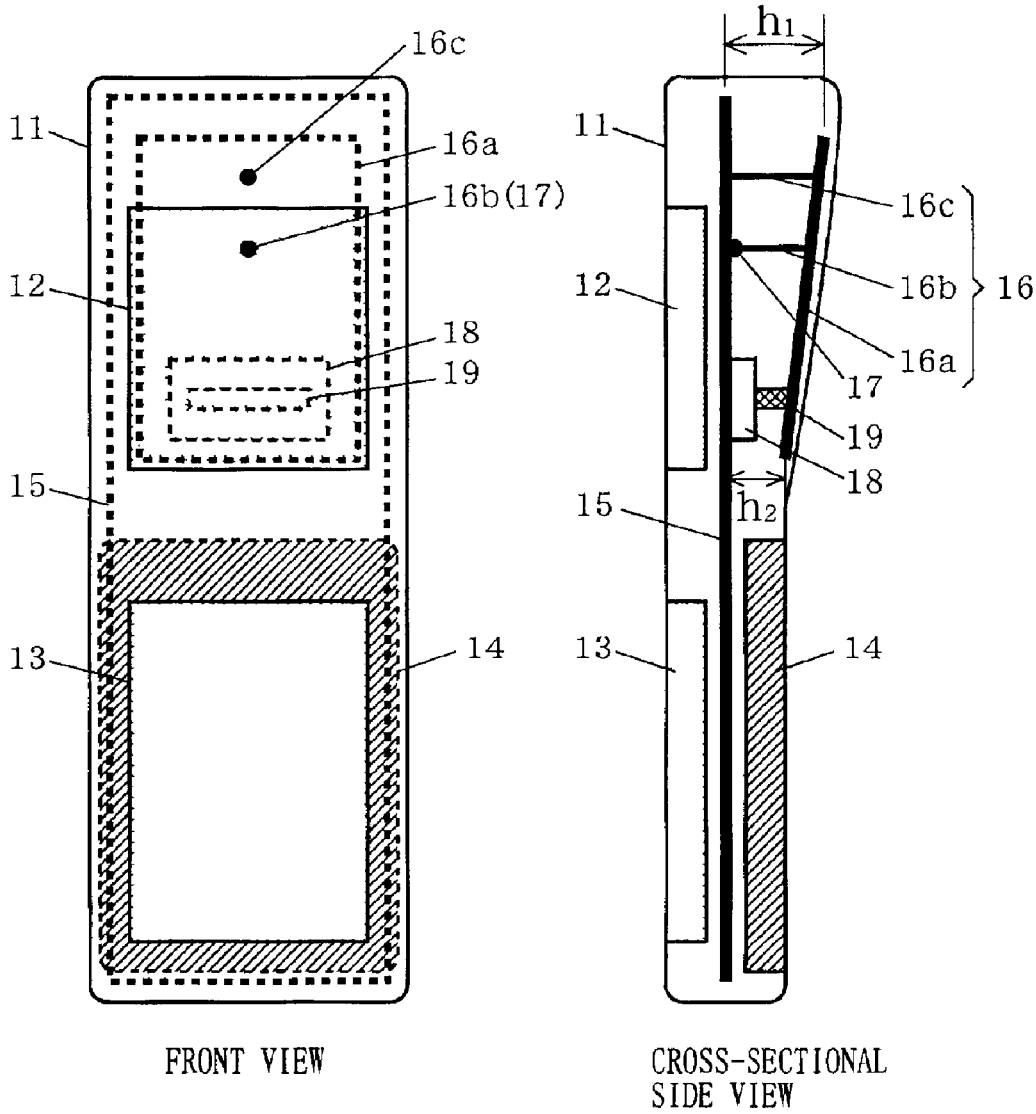

As another alternative structure, a shield may be placed between the built-in antenna 16 and the base plate 15 of FIG. 1. FIG. 3 shows an example of the mobile radio in such a structure. Here, in FIG. 3, any constituent identical to that in FIG. 1 is provided with the same reference numeral.

The mobile radio of FIG. 3 further includes a shield 18 and an antenna support base 19. The antenna element 16*a* is fixed via the antenna support base 19 to the shield 18, which is placed on the base plate 15. Assuming here that the shield 18 has a wireless circuit therein. The original purpose of placing the shield 18 is to protect the wireless circuit provided therein from radio waves radiated from the antenna 16. In this case, the shield 18 also can lead to easier impedance matching of the antenna 16. This is because the capacitive coupling can be controlled by adjusting the height of the shield 18, or the space between the shield 18 and the antenna element 16*a*. Furthermore, the characteristics of the built-in antenna 16 can be stabilized by fixing the built-in antenna 16 with the help of the antenna support base 19. Moreover, with the antenna support base 19 made of dielectric material, the resonant frequency of the antenna will be lowered so that the antenna can surely be downsized.

In the mobile radio of the present embodiment, the built-in antenna 16 is slanted against the base plate 15 so that the antenna height, i.e., space to the base plate 15, at the upper part of the antenna is larger than that at the lower part. This structure is not restrictive, and the upper end of the cabinet may be rounded from a design perspective, or the antenna element 16*a* may be provided with a conductor wall to increase the capacitive coupling with the base plate 15, for example. In such cases, the same effects as above are also surely expectable.

As described above, according to the mobile radio of the first embodiment, the built-in antenna 16 is slanted against the base plate 15 so that the space therebetween is decreased from the upper part to the lower part, and the supply portion is placed on the upper part. With such a structure, the antenna characteristics can be enhanced due to the supply portion placed on the upper part, and the capacitive coupling can be increased due to the closeness between the lower part of the antenna and the base plate 15, successfully lowering the resonant frequency of the antenna 16. Furthermore, from a design perspective, users' hands do not cover the antenna part when holding the mobile radio, and the mobile radio has a better appearance.

Second Embodiment

Figure 4:
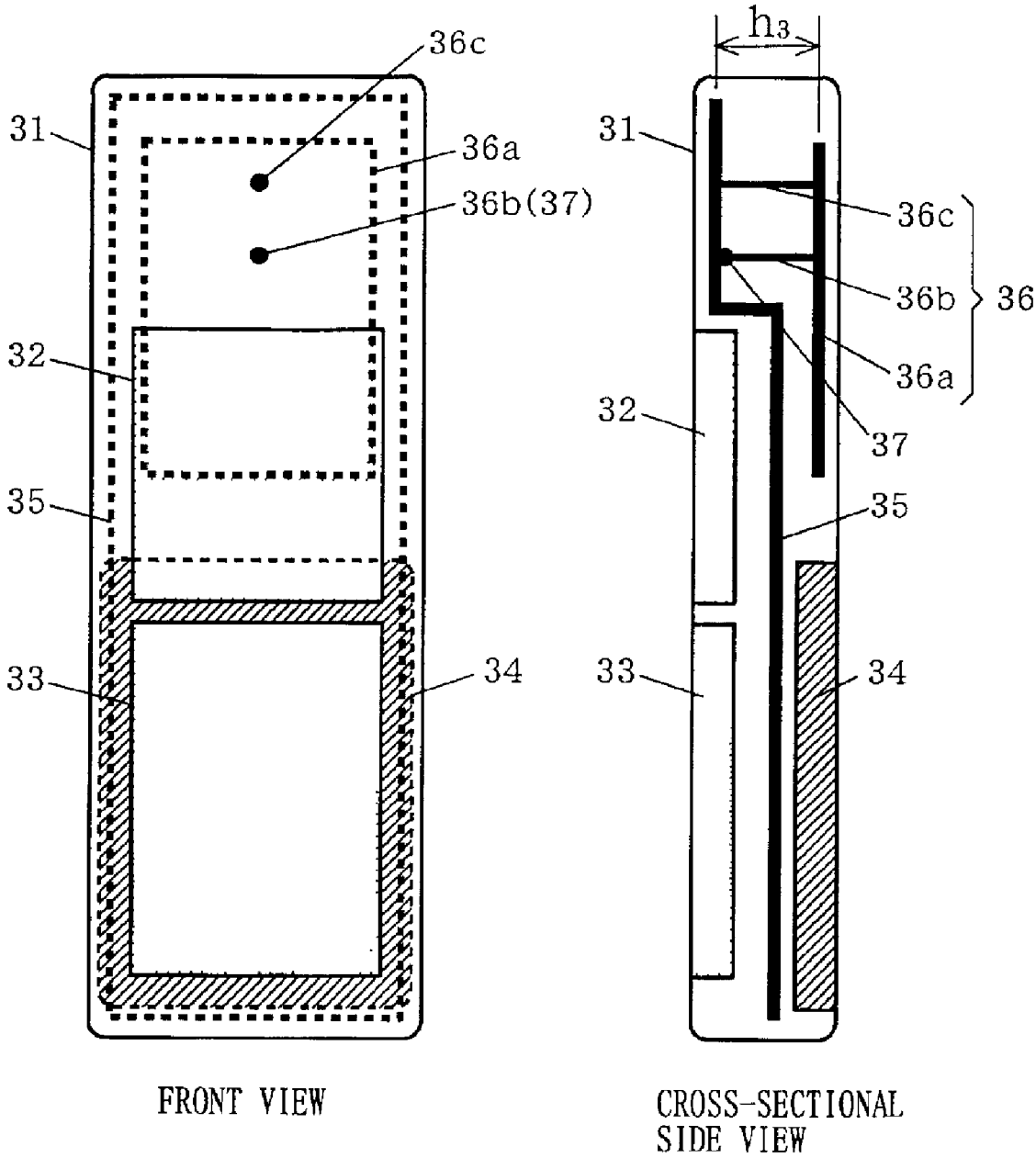
FIG. 4 is a schematic illustration showing the structure of a mobile radio according to a second embodiment of the present invention.

FIG. 4 schematically shows front and cross-sectional side views of a mobile radio according to a second embodiment of the present invention.

In FIG. 4, the mobile radio of the second embodiment includes a cabinet (case) 31, a display 32 exemplified by a liquid crystal display, a key-section 33 exemplified by a ten-key numeric pad, a battery 34, a built-in antenna 36, and a base plate 35 for electrical connections among those constituents. The built-in antenna 36 is structured by an antenna element 36*a* of a planar configuration, and two metal leads 36*b* and 36*c*. The antenna element 36*a* is provided with a predetermined voltage from a supply point 37 on the base plate 35 via the metal lead 36*b*. The antenna element 36*a* is connected to a ground (GND) level of the base plate 35 via the metal lead 36*c*.

The base plate 35 is structured by an antenna-housing section which affects the antenna characteristics, and a circuit-housing section which is the rest of the base plate 35. Specifically, the antenna-housing section includes, for example,a portion (supply portion) at where the metal lead 36*b* is connected with the antenna element 36*a*, and a portion (short-circuiting portion) at where the metal lead 36*c* is connected with the antenna element 36*a*. In accordance with the desired antenna characteristics, the antenna-housing section is so positioned as to keep the built-in antenna 36 high enough, that is, to keep the space between the base plate 35 and the antenna element 36*a* large enough. The antenna-housing section is thus positioned toward the front side in the cabinet 31. On the other hand, the circuit-housing section is positioned toward the back of the cabinet 31 to provide room for the display 32 and the key section 33. By structuring the base plate 35 as such, the cabinet 31 can accommodate the display 32 and the key section 33 therein without reducing the height $h_3$ of the built-in antenna 36. As a result, the cabinet 31 can be successfully reduced in thickness.

Figure 5:
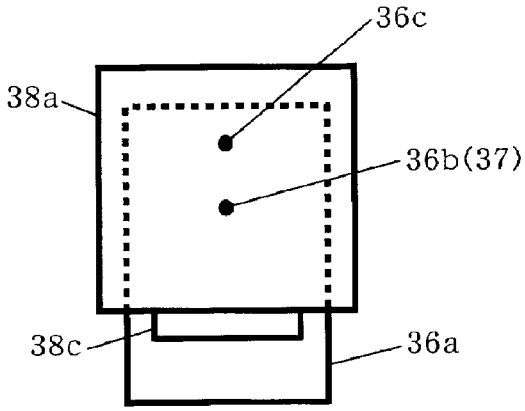
FIGS. 5 and 6A–6C are schematic illustrations showing other structures of the mobile radio according to the second embodiment of the present invention.
Figure 5:
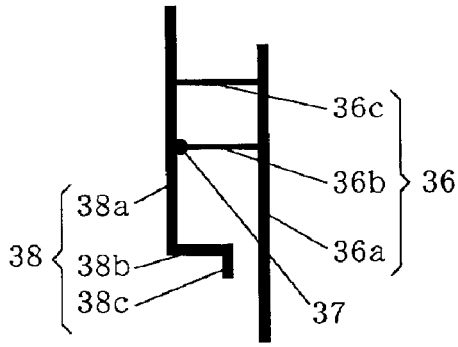
Figure 5:
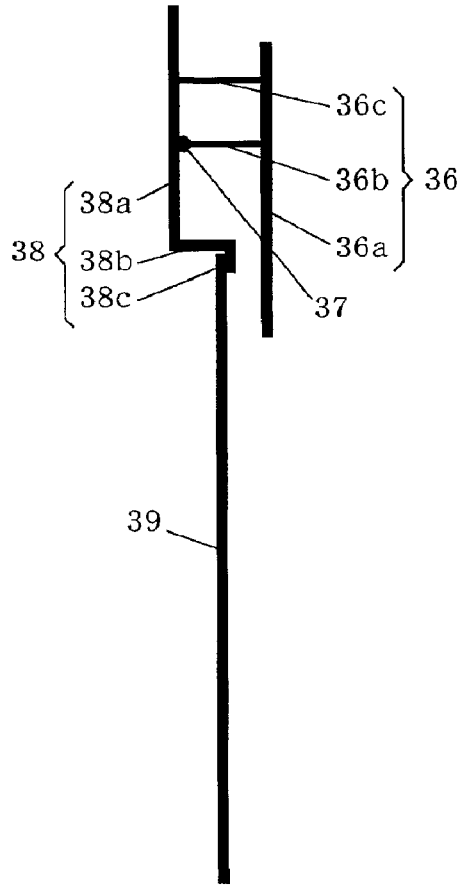

Here, alternatively, the base plate 35 may be structured by several base plates; some are for housing the built-in antenna, and some are for housing the circuit. FIG. 5 shows an example of the base plate in such a structure. Here, in FIG. 5, any constituent identical to that in FIG. 4 is provided with the same reference numeral.

In FIG. 5, the base plate is structured by an antenna-housing base plate 38, and a circuit base plate 39. The antenna-housing base plate 38 is composed of a base plate 38*a*, a side wall 38*b*, and a junction 38*c*. The base plate 38*a* is connected to the junction 38*c* via the side wall 38*b*. The built-in antenna 36 is placed on the base plate 38*a*. To assemble the base plate of this type, the built-in antenna 36 is first placed on the antenna-housing base plate 38, and then the antenna-housing base plate 38 is connected is connected to the circuit base plate 39 via the junction 38*c*. In such a manner, the antenna part, i.e., the antenna-housing base plate 38 plus the built-in antenna 36, can be manufactured separately, and thus the productivity will be increased.

In the second embodiment, characteristically, the antenna-housing base plate 38 and the circuit base plate 39 are formed and placed separate from each other so that their surfaces are not aligned on the same plane. Here, by adjusting the space between the side wall 38*b* and the antenna element 36*a*, the capacitive coupling can be accordingly controlled, and this can lead to easier impedance matching. Here, the junction 38*c* may simply abut to the circuit base plate 39 as long as electrical connection is established therebetween.

Figure 6A:
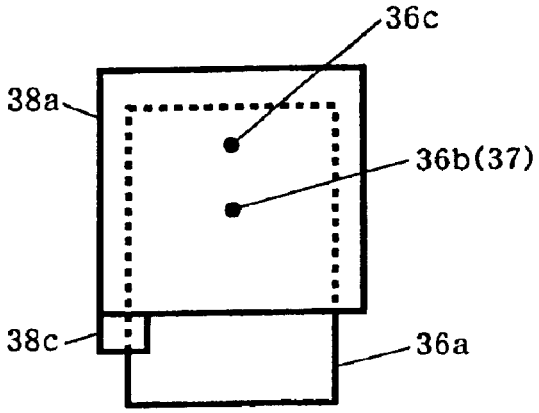
Figure 6A:
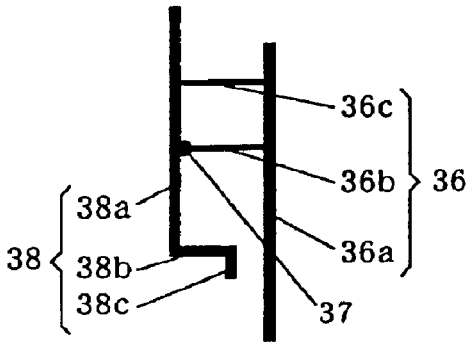
Figure 6A:
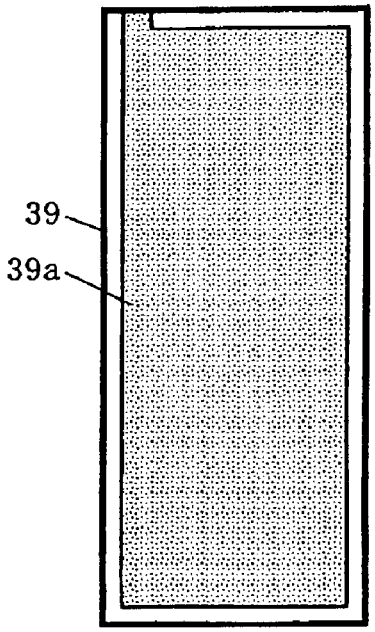
Figure 6A:
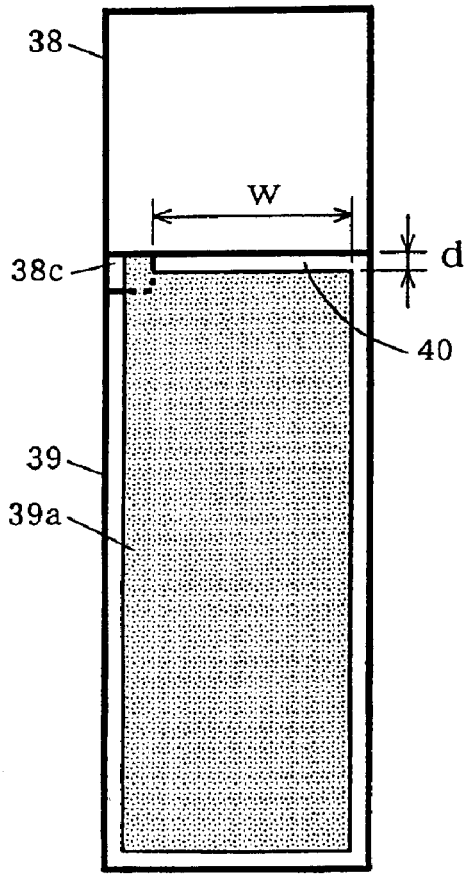

By referring to FIG. 6A, if the junction 38*c* of the antenna-housing base plate 38 and a conductive pattern 39*a* on the circuit base plate 39 are both changed in shape, a slit 40 may be formed between the antenna-housing base plate 38 and the circuit base plate 39 when those are coupled to each other. In this case, if the slit 40 is so generated as to be ¼λ (wavelength) in length w, the impedance considering the circuit base plate 39 becomes maximum. Accordingly, the built-in antenna 36 can be designed irrelevant to the circuit base plate 39, and the built-in antenna 36 thus becomes more versatile, suitable for mass production. Explained by referring to FIG. 6A is a case where the slit 40 is adjusted in length w and width d by changing the shape of the junction 38*c* and the conductive pattern 39*a* in shape. Alternatively, the slit 40 may be adjusted by using any other parameters.

In the case of FIG. 6A, although the slit 40 is provided between the antenna-housing base plate 38 and the circuit base plate 39, this is not restrictive. In the case where the base plate includes no side wall 38*b* as the base plate 15 of the first embodiment, there is no problem of providing a slit.

Moreover, the characteristics of the built-in antenna may be optimized by adjusting, by the slit 40, the length of a current path. If this is the case, the number of slits is not restricted to one. For example, if a plurality of slits are provided, the base plate can be increased in size equivalently. Also, if the slits are provided to the base plate where the current distribution is high in such a manner as to across the current path, the base plate can be surely increased in size equivalently.

Here, the structures of the first and second embodiments can surely be combined together. With the resultant structure, the antenna can be put higher so that the antenna characteristics can be enhanced.

As described above, in the mobile radio of the second embodiment, the base plate is structured by the antenna-housing section and the circuit-housing section, and these sections are placed so as not to align on the same plane for the purpose of providing room for other constituents. With such a structure, the built-in antenna can be high enough without increasing the thickness of the mobile radio, successfully leading to enhancement in antenna characteristics.

Here, described in the first and second embodiments are the cases where the built-in antenna is a planar inverted F antenna, and this is not restrictive. As to the first embodiment, the same effects are surely achieved by slanting the built-in antenna so that the part of the antenna where the current distribution is the highest, i.e., the part that determines the height of the antenna, is put higher than the rest. The same effects are to be achieved by structuring, instead of slanting, the built-in antenna as steps to change the height thereof. As to the second embodiment, the same effects are surely achieved by structuring the built-in antenna in such a manner that the part of the antenna where the current distribution is the highest, i.e., the part that determines the height of the antenna, is put higher than the rest.

Here, although the mobile radios of the first and second embodiments are provided with one antenna, this is not restrictive. The built-in antenna of the present invention can surely be used together with an extendable whip antenna, or several of the built-in antennas can be used together. In such case, the same effects are to be achieved, as well.

Figure 6C:
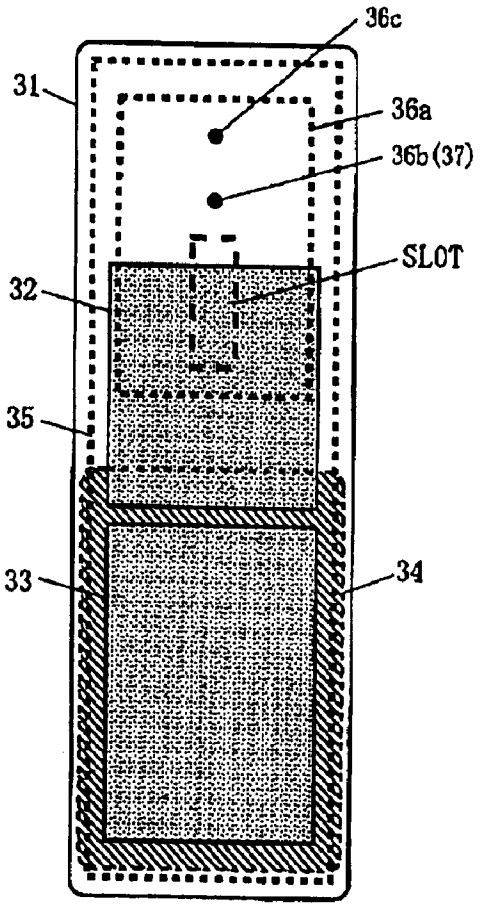
Figure 6B:
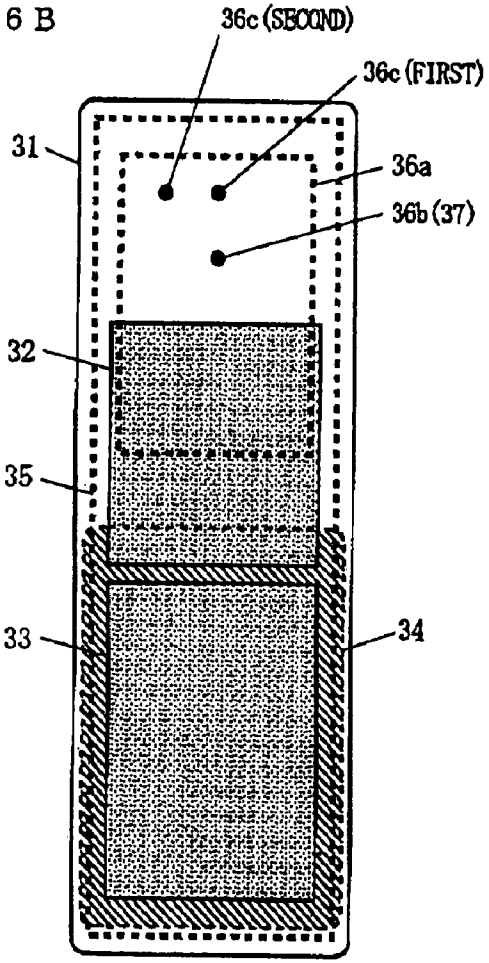

The mobile radio of the present invention surely covers a plurality of frequency bands. In the case of using several antennas together, those antennas can be structured so as to cover a plurality of frequency bands. When using an antenna capable of covering a plurality of frequency bands, a short-circuiting portion (or a supply portion) for a first resonant frequency band, and a short-circuiting portion (or a supply portion) for a second resonant frequency band as shown in FIG. 6B are both provided on its antenna element so that conduction for the short-circuiting portions (or voltage supply to the supply portions) are selectively controlled. With such a structure, either of the first resonant frequency band or the second resonant frequency band can be covered. In order to cover these two resonant frequency bands at the same time, the antenna element may be provided with a slot as shown in FIG. 6C so that the original antenna element determines the first resonant frequency band, and the slot part the second resonant frequency band.

Moreover, filling partially or entirely a space between the built-in antenna and the base plate with the dielectric material will downsize the built-in antenna, and also stabilize it on the base plate.

Figure 7:
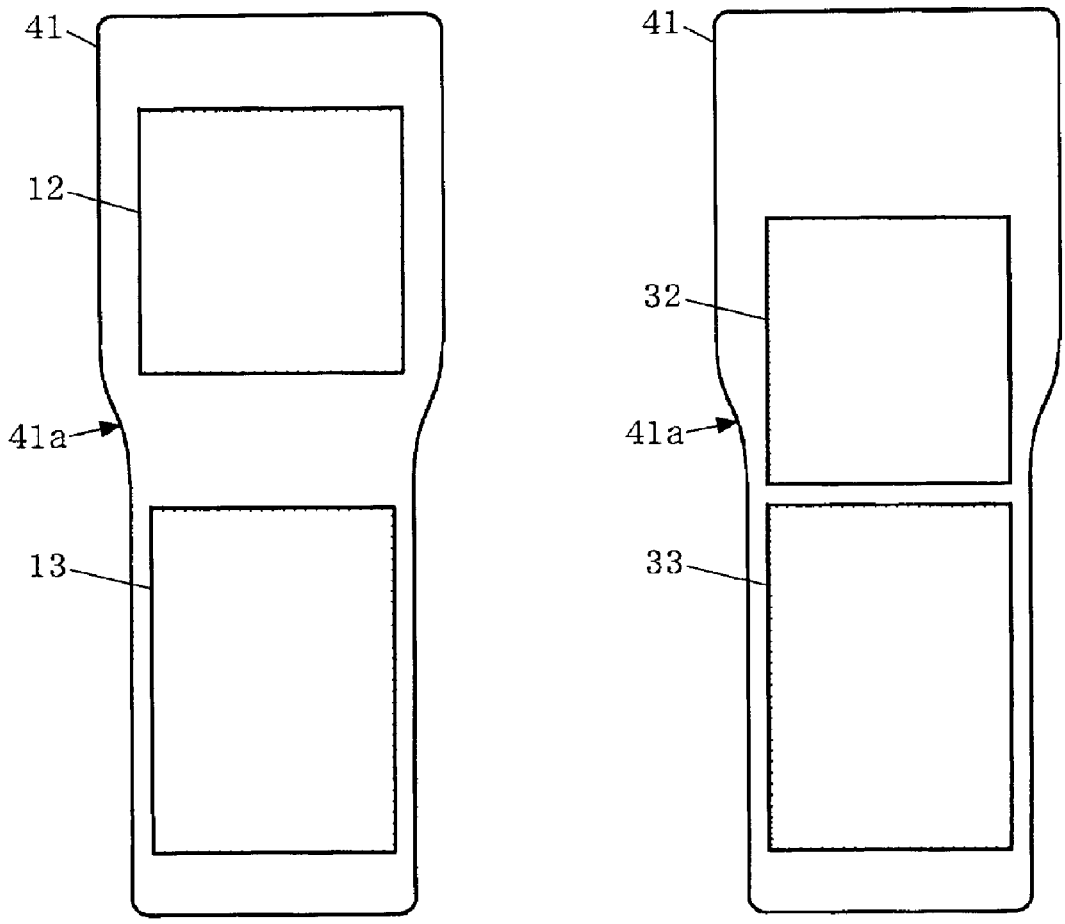
FIG. 7 is a schematic illustration showing an exemplary cabinet applicable to the mobile radios according to the first and second embodiments of the present invention.
Figure 8:
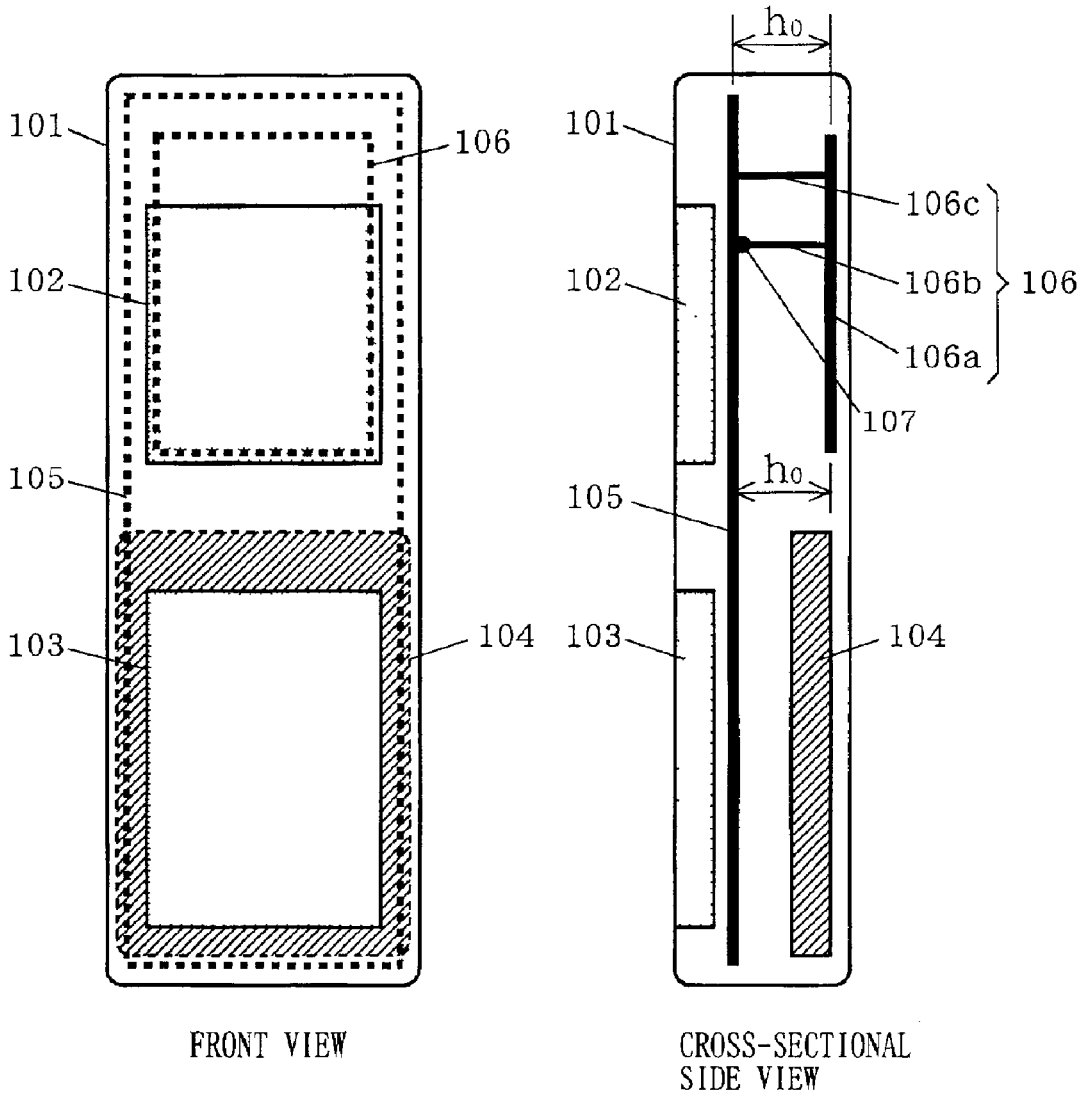
FIG. 8 PRIOR ART
FIG. 8 is a schematic illustration showing the structure of a conventional mobile radio.

Lastly, as to the mobile radios of the first and second embodiments, FIG. 7 shows an example of their cabinet which is designed to decrease in width at some point for the users to place their fingers thereon.

In FIG. 7, the width of a cabinet (case) 41 is started to narrow at the lower end of the antenna-housing section which affects the antenna characteristics, and hereinafter the area therearound is referred to as a finger-placing section 41*a*. With the finger-placing section 41*a*, the users may hold the lower part of the mobile radio, and thus the antenna characteristics are prevented from being deteriorated. Moreover, since the upper part of the cabinet 41 remains wide, the width of the built-in antenna can be wider. Specifically for the mobile radio will be first embodiment, the size of the display can be increased. The resultant mobile radio will be considered user-friendly as an information terminal.

Herein, it is surely possible to provide a plurality of finger-placing sections, and if so, arranging those in order in the vertical direction may allow the users to more easily hold the mobile radio. Also, the users may know which part of the mobile radio they are expected to hold, avoiding the antenna part.

While the invention has been described in detail, the foregoing description is in all aspects illustrative and not restrictive. It is understood that numerous other modifications and variations can be devised without departing from the scope of the invention.

What is claimed is:

1. The mobile radio having an antenna equipped for receiving and transmitting radio waves, said mobile radio comprising:

a base plate for providing a ground level;

a built-in antenna which is disposed on said base plate, and a case defining an outer appearance of said mobile radio, said case being formed in accordance with a shape of said built-in antenna, wherein said built-in antenna is provided with a supply portion at the upper end thereof when said mobile radio is in a standing position, and is disposed so that a space between said built-in antenna and said base plate decreases from said upper end to the lower end, said built-in antenna is an antenna of a planar configuration, and is slanted that the space between said built-in antenna and said base plate is larger at said upper end than at said lower end, said case is formed smoothly in accordance with the slant of said built-in antenna, said base plate comprises an antenna-housing base plate on which said built-in antenna is disposed, and a circuit base plate which is a remainder of said base plate, and said antenna-housing base plate and said circuit base plate are not aligned on a same plane.

2. The mobile radio according to claim 1, wherein said built-in antenna is a planar inverted F antenna including an antenna element, a supply connection member to which a predetermined voltage is supplied, and a short-circuiting connection member which is grounded to said base plate, and said supply connection member and said short-circuiting connection member are disposed on said upper end.

3. The mobile radio according to claim 1, further comprising a shield is provided between said built-in antenna and said base plate.

4. The mobile radio according to claim 3, wherein said built-in antenna is fixed by a support base which is disposed on said shield.

5. The mobile radio according to claim 1, wherein said case comprises a first section which houses said built-in antenna, and a second section which is the reminder of said case, and said built-in antenna is previously attached to the first section.

6. The mobile radio according to claim 1, wherein said antenna-housing base plate and said circuit base plate are electrically connected to each other via a side wall.

7. The mobile radio according to claim 1, further comprising a slit is provided in the vicinity of a junction between said antenna-housing base plate and said circuit base plate.

8. The mobile radio according to claim 7, wherein the length of said slit is a ¼ wavelength of any desired resonant frequency.

9. The mobile radio according to claim 1, further comprising a dielectric material, wherein the space between said built-in antenna and said base plate is partially or entirely filled with said dielectric material.

10. The mobile radio according to claim 1, wherein said built-in antenna includes short-circuiting connection members which are grounded to said base plate, and determine, respectively, a first resonant frequency band and a second resonant frequency band, and either of the first or second resonant frequency bands is selectively covered by controlling conduction for the short-circuiting members, and said built-in antenna resonates with at least two frequencies.

11. The mobile radio according to claim 1, wherein said built-in antenna includes an antenna element, a slot, and a short-circuiting connection member which is grounded to said base plate and said slot, and determine, respectively, a first resonant frequency band and a second resonant frequency band, and by an action of said antenna element and said slot, the first and second resonant frequency bands are covered at a same time, and said built-in antenna resonates with at least two frequencies.

12. The mobile radio having an antenna equipped for receiving and transmitting radio waves, said mobile radio comprising:

a base plate for providing a ground level;

a built-in antenna which is disposed on said base plate, and a case defining an outer appearance of said mobile radio, said case being formed in accordance with a shape of said built-in antenna, wherein said built-in antenna is provided with a supply portion at the upper end thereof when said mobile radio is in a standing position, and is disposed so that a space between said built-in antenna and said base plate decreases from said upper end to the lower end, said built-in antenna comprises a plurality of planes, and the plurality of planes are structured as steps so that the space between said built-in antenna and said base plate is larger at said upper end than at said lower end, said case is formed so as to have a smooth envelope accommodating corner of said plurality of planes of said built-in antenna, said base plate comprises an antenna-housing base plate on which said built-in antenna is disposed, and a circuit base plate which is a remainder of said base plate, and said antenna-housing base plate and said circuit base plate are not aligned on a same plane.

13. The mobile radio according to claim 12, wherein said built-in antenna is a planar inverted F antenna including an antenna element, a supply connection member to which a predetermined voltage is supplied, and a short-circuiting connection member which is grounded to said base plate, and said supply connection member and said short-circuiting connection member are disposed on said upper end.

14. The mobile radio according to claim 12, further comprising a dielectric material, wherein a space between said built-in antenna and said base plate is partially or entirely filled with said dielectric material.

15. The mobile radio according to claim 12, wherein said built-in antenna includes short-circuiting connection members which are grounded to said base plate, and determine, respectively, a first resonant frequency band and a second resonant frequency band, and either of the first or second resonant frequency bands is selectively covered by controlling conduction for the short-circuiting members, and said built-in antenna resonates with at least two frequencies.

16. The mobile radio according to claim 12, wherein said built-in antenna includes an antenna element, a slot, and a short-circuiting connection member which is grounded to said base plate and a slot, and determine, respectively, a first resonant frequency band and a second resonant frequency band, and by an action of an said antenna element and the slot, the first and second resonant frequency bands are covered at the same time, and said built-in antenna resonates with at least two frequencies.

17. The mobile radio according to claim 12, further comprising a shield provided between said built-in antenna and said base plate.

18. The mobile radio according to claim 17, wherein said built-in antenna is fixed by a support base which is disposed on said shield.

19. The mobile radio according to claim 12, wherein said case comprises a first section which houses said built-in antenna, and a second section which is a reminder of said case, and said built-in antenna is previously attached to the first section.

20. The mobile radio according to claim 12, wherein said antenna-housing base plate and said circuit base plate are electrically connected to each other via a side wall.

21. The mobile radio according to claim 12, further comprising a slit provided in a vicinity of a junction between said antenna-housing base plate and said circuit base plate.

22. The mobile radio according to claim 21, wherein a length of said slit is a ¼ wavelength of any desired resonant frequency.

* * * * *

UNITED STATES PATENT AND TRADEMARK OFFICE

CERTIFICATE OF CORRECTION

PATENT NO. : 6,897,814 B2
DATED : May 24, 2005
INVENTOR(S) : Hiroshi Iwai et al.

It is certified that error appears in the above-identified patent and that said Letters Patent is hereby corrected as shown below:

Title page,
Item [56], References Cited, OTHER PUBLICATIONS, please correct the first reference to read as follows:
-- Poddar, D.R. et al. "On some board-band microstrip resonators" IEEE Transactions on Antennas and Propagation, IEEE Inc. New York, US, vol. AP-31, No. 1, Jan. 1983, pp. 193-194. --.
Item [57], ABSTRACT,
Line 1, please replace "antenna is" with -- antenna that is --.
Line 7, please replace "the rest" with -- a remainder --.
Line 8, please replace "is so positioned so" with -- is positioned so --.

Column 8,
Line 58, please replace "The" with -- A --.
Line 62, please replace "plate," with -- plate; --.

Column 9,
Line 2, please replace "the" with -- an --.
Lines 5, 34 and 45, please replace "the" with -- a --.
Line 7, please replace "slanted that" with -- slanted so that --.
Line 27, please replace "shield is provided" with -- shield provided --.
Line 42, please replace "slit is provided in the" with -- slit provided in a --.
Line 58, please replace "the" with -- said --.
Lines 58-59, please replace "short-circuiting members," with -- short-circuiting connection members, --.

Column 10,
Line 9, please replace "The" with -- A --.
Line 13, please replace "plate," with -- plate; --.
Line 19, please replace "the" with -- an --.
Lines 22 and 65, please replace "the" with -- a --.
Line 28, please replace "corner" with -- corners --.
Line 55, please replace "short-circuiting members" with -- short-circuiting connection members--.
Line 61, please replace "a" with -- said --.

UNITED STATES PATENT AND TRADEMARK OFFICE

CERTIFICATE OF CORRECTION

PATENT NO. : 6,897,814 B2
DATED : May 24, 2005
INVENTOR(S) : Hiroshi Iwai et al.

It is certified that error appears in the above-identified patent and that said Letters Patent is hereby corrected as shown below:

Column 10 (cont'd),
Line 64, please replace "the" with -- said --.

Signed and Sealed this

Eleventh Day of October, 2005

JON W. DUDAS
*Director of the United States Patent and Trademark Office*